United States Patent [19]

Beauchemin

[11] Patent Number: 4,864,741

[45] Date of Patent: Sep. 12, 1989

[54] ANKLE SUPPORT

[76] Inventor: Pierre Beauchemin, 110 de Grandmont, R.R. no 3, St-Augustin, Quebec G3A 1G5, Canada

[21] Appl. No.: 205,638

[22] Filed: Jun. 13, 1988

[51] Int. Cl.[4] ..... A43B 7/20; A61F 5/00

[52] U.S. Cl. ..... 36/89; 36/10; 128/80 H; 128/166; 2/239

[58] Field of Search ..... 128/80 H, 166, 80 S; 36/88, 89, 90, 10; 24/143 B; 2/239, 22

[56] References Cited

U.S. PATENT DOCUMENTS

| | | | |
|---|---|---|---|
| 1,084,197 | 1/1914 | Collis | 36/89 X |
| 1,717,609 | 6/1929 | Ludwig | 128/166 |
| 1,753,858 | 4/1930 | Gay | 128/166 |
| 2,789,374 | 4/1957 | Planert | 36/89 |
| 3,327,410 | 6/1967 | Park Sr., et al. | 36/89 |
| 3,383,708 | 5/1968 | Pappas | 2/22 |
| 4,133,311 | 1/1979 | Karczewski | 128/80 H X |
| 4,323,059 | 4/1982 | Detty | 128/80 C |
| 4,409,976 | 10/1983 | Pence | 128/80 H X |
| 4,440,158 | 4/1984 | Shapiro | 128/80 H |
| 4,461,288 | 7/1984 | Curtis | 128/80 H |
| 4,621,648 | 11/1986 | Ivany | 128/80 H |
| 4,649,939 | 3/1987 | Curtis | 128/80 H |
| 4,670,998 | 6/1987 | Pasternak | 36/89 X |

FOREIGN PATENT DOCUMENTS

| | | | |
|---|---|---|---|
| 28897 | of 1910 | United Kingdom | 128/166 |
| 485313 | 5/1938 | United Kingdom | 128/166 |

*Primary Examiner*—Edgar S. Burr
*Assistant Examiner*—Moshe L. Cohen
*Attorney, Agent, or Firm*—Larson and Taylor

[57] ABSTRACT

The invention relates to an ankle support system to protect against ankle injuries. The ankle support system comprises a leg brace mounted to the leg of the wearer and an anchoring strap for attaching the leg brace to a shoe. The anchoring strip comprises a series of eyelets receiving a shoe lace and firmly retaining the anchoring strip to the shoe.

9 Claims, 3 Drawing Sheets

12
16
14
15

36
14
15
38

ANKLE SUPPORT

The present invention relates to the general field of injury prevention and, more particularly, to an ankle support system to protect against sports-related injuries of the ankle joint of the foot.

Ankle injuries resulting from over-inversion (i.e. forced internal rotation and flexion) of the ankle joint in sports such as running, tennis or basketball, among others, are commonly seen in sports medicine. Such ankle injuries vary in severity from simple ligaments pulls to ligament ruptures and bone fractures. In certain cases, lengthy time periods are required to achieve full recovery and some of the sprains tend to recur, especially those due to a forced inversion of the ankle.

To protect against such injuries, it has been common practice among athletes to use orthopedic devices for limiting the natural ankle movements that are normally encountered in the course of walking or running. Such orthopedic devices are typically in the form of ankle braces, elastic bandages or the like, made of stiff material, laced, wrapped or otherwise attached to the ankle. However, those have not been very popular among the public, because they have the effect of excessively restricting most of the ankle movements resulting in poor athletic performance, as well as being uncomfortable to wear.

Due to the lack of success of conventional ankle braces and related techniques to solve the sports-related ankle injuries, a new preventive technique was developed in the past recent years to solve this problem. The technique consists of anchoring the ankle of the foot to the shoe to limit the inversion of the foot, instead of simply limiting most of the ankle movements by means of stiffening materials. The U.S. Pat. No. 4,621,648, granted to Michael Ivany, on Nov. 18, 1986, is illustrative of the prior art relating to this technology. This patent relates to an ankle support system comprising two elements, namely an ankle brace to be laced on the leg and a pair of straps, having each one end permanently attached to the shoe and an opposite end releasably attached to the ankle brace. The length of the straps is such as to restrain the ankle-joint against over-inversion and at the same time, permit the ankle to freely move in other directions normally encountered during running or walking.

Although effective for protection against injuries, this device has not found wide acceptance among the public because it requires a permanent modification of the shoe, thus making the shoe unsuitable for uses other than sports related activities. ankle injuries and, at the same time, is comfortable to wear, easy to install and does not require any permanent modification of the shoe.

The object of the invention is achieved by providing an ankle support system, for use exclusively with lacing type athletic footwear, comprising a leg brace for mounting to the leg and a brace anchoring strap connected to the leg brace and also being secured to the lacing of the shoe. The leg brace comprises a generally flexible and preferably unelastic band having a length sufficient to completely encircle the lower leg of the wearer, the extremities of the flexible band being provided with releasable fastening means. To prevent the flexible band from sliding upwardly on the ankle of the wearer, a retaining strap is provided having both ends attached to the flexible band and passing under the planar surface of the arched portion of the foot or under the removable sole of the shoe.

The anchoring strap, for securing the leg brace to the footwear, comprises lace engaging means which is constituted in a preferred embodiment by a series of eyelets for receiving the shoe lace, the anchoring strap being provided preferably with releasable fastening means for attachment to the leg brace.

The length of the brace anchoring strap is such as to prevent over-inversion of the ankle joint and, at the same time, to allow the ankle to freely move in other directions.

The ankle support system, according to the present invention, provides numerous advantages over prior designs The main advantage resides in the ease of installation of the system on the shoe which, for this purpose, doesn't have to be altered permanently in any way. Thus, the system may be easily removed from the shoe when the ankle support system is not required.

Also, the ankle support system is comfortable to wear and it may be installed fairly easily.

Therefore, the present invention comprises, in a broad aspect, an ankle support system for use with athletic footwear of the lacing type, the ankle support system including:

a leg brace adapted to be removably affixed to a leg which is adapted to be received in the athletic footwear; and an anchoring strap mounted to the leg brace for retaining the ankle brace to the athletic footwear, the anchoring strap comprising lace engaging means for removably attaching the anchoring strap to the lacing, the ankle support constituting means to limit over-inversion movement of the ankle-joint of the foot.

A preferred embodiment of the present invention will now be described with relation to the annexed drawings in which.

Figure 1:
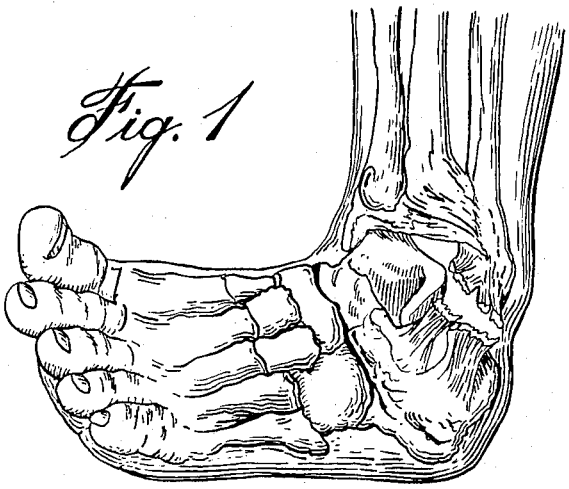
FIG. 1 is a schematical view illustrating a human foot in over-inversion of the ankle.

Referring now to the drawings, FIG. 1 illustrates the position of a human leg in over-inversion of the ankle joint that may result in an injury to the ankle. Such injuries are often sports-related and occur mostly in athletic activities where the individual changes motion and direction frequently. For example, when running or playing tennis, during a sudden stop of the participant, the momentum acquired by the human body is exerted on the ankle while the shoe firmly engages the ground and it does not permit any lateral motion, causing forced inversion of the foot that could cause tear of ligamentous structures of the ankle.

Figure 2:
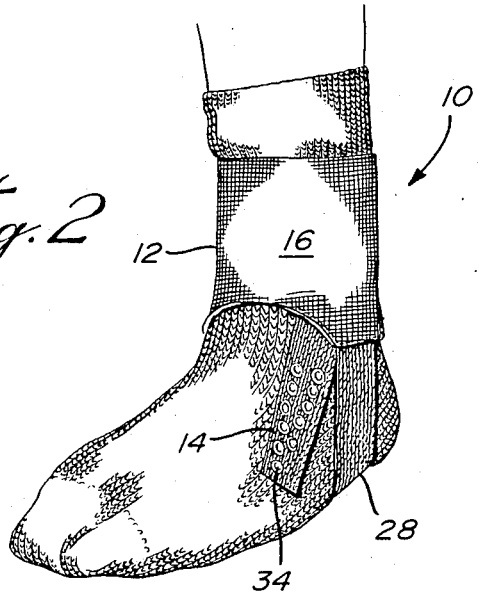
FIG. 2 is a perspective view of the ankle support system, according to the invention, shown on the foot of a wearer, the shoe being omitted.
Figure 4:
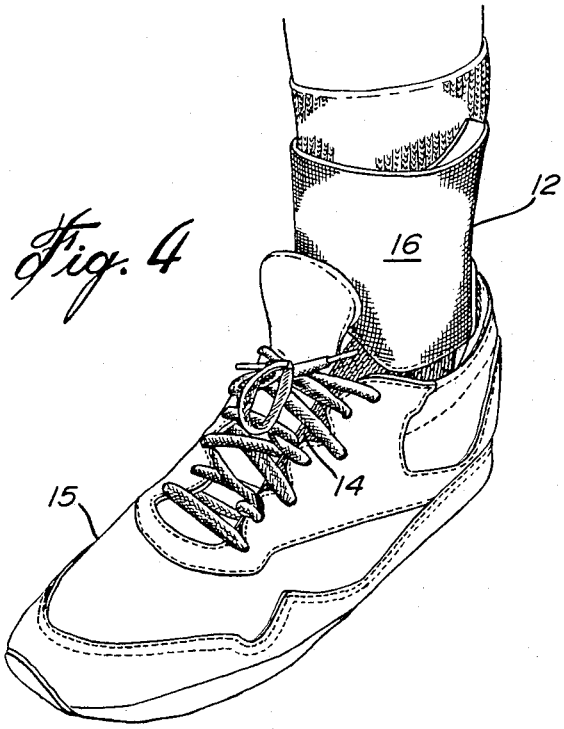
FIG. 4 is a perspective view of the ankle support system, according to the invention, the foot of a wearer being received in a shoe.
Figure 3:
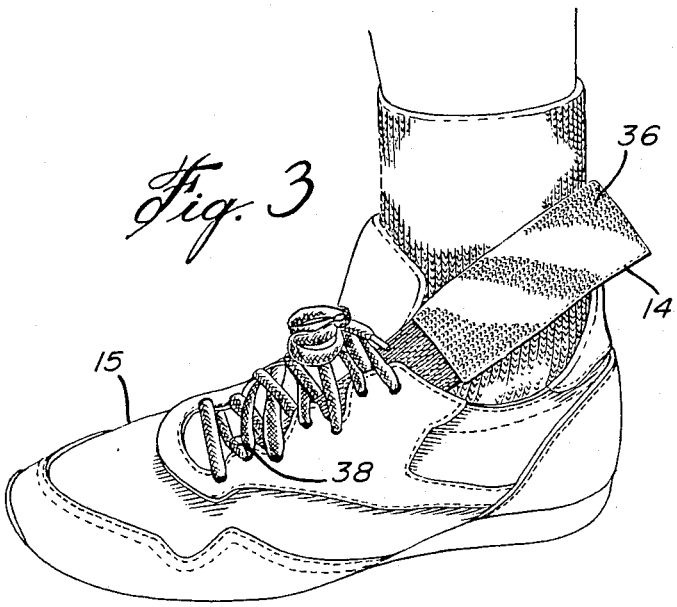
FIG. 3 is a perspective view of an anchoring strip of the ankle support system, mounted to a shoe.

FIGS. 2, 3 and 4 illustrate the ankle support system, according to the invention, designed for protecting against such sport related ankle injuries. The ankle support system, identified generally by the reference numeral 10, comprises two main components, namely a leg brace 12 and an anchoring strap 14 for attaching the leg brace 12 to a shoe 15 of the lacing type. The anchoring strap 14 is of such a length so as to prevent the over-inversion movement of the foot, shown in FIG. 1.

Figure 5:
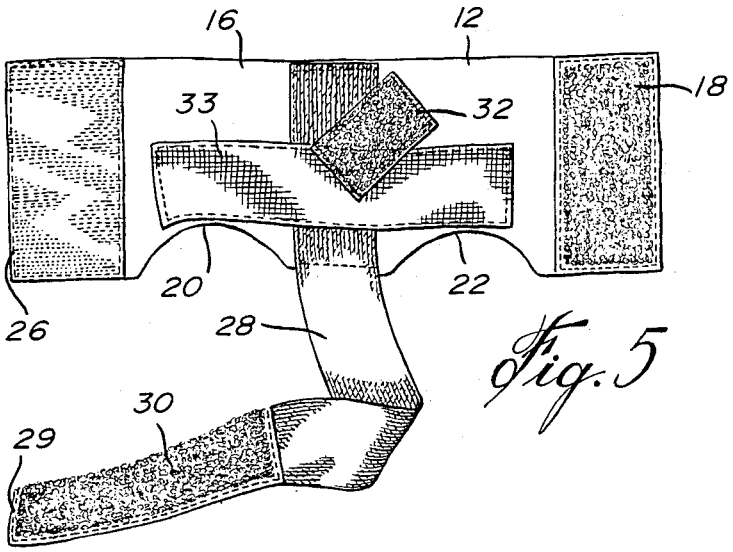
FIG. 5 illustrates in perspective the leg brace.

The leg brace best illustrated in FIG. 5, comprises a relatively wide band 16 of flexible but inelastic material adapted to be wrapped on the lower leg of the wearer. The length of the band 16 is such as to completely surround the lower leg and includes end fastening means of the hook and loop type, designated in the trade by the term "VELCRO" (Trademark), for attaching the ends of the band 16 together. More particularly at one end of the band 16, on the inner face thereof, is applied a pad 18 of loop type fastening material while on the opposite end of the band 16, on the outer face thereof, is mounted a pad 19 of hook type fastening material, best shown in FIG. 6. The hook and loop type fastening pads are preferably attached to the band 16 by stitching, although other methods may be envisaged such as by means of adhesives.

The use of VELCRO type fastening material for attachment of the band 16 is extremely advantageous because it enables quick and easy application of the appliance as well as a range of adjustability for fitting on various leg sizes which is difficult to obtain with other type of fasteners. Furthermore, the Velcro type fasteners are comfortable for the user.

On the bottom edge of the band 16 are formed two cut-out portions 20 and 22 respectively, generally semicircular in shape to accomodate the heel portion and the arch portion of the foot respectively, when the band 16 is applied on the lower leg of the wearer.

Opposite the pad 18 of loop type fastening material, is provided a pad 26 of hook type fastening material of about the same size. The purpose of the pad 26 will become clear as the description proceeds.

A retaining strap 28 extending generally perpendicularly to the longitudinal axis of the band 16, has one end stitched or otherwise permanently attached to the band 16 generally between the cut-out portions 20 and 22. The opposite end 29 of the retaining strap 28 is provided with a pad 30 of loop type fastening material for engagement with the hook type pad 26 on the band 16.

Between the fastening pads 26 and 18 is provided an additional fastening pad 32 of loop type fastening material for engagement with the anchoring strap 14.

The band 16 further comprises a stiffening strap 33 extending longitudinally on the band 16. The strap 33 is flexible but unelastic and its purpose is to prevent stretching of the lower portion of the band 16 when the latter is applied on the foot.

As best shown in FIGS. 2, 3 and 4, the anchoring strap 14 made of a flexible but inelastic material comprises at one end a series of eyelets 34 for engagement with the lacing of the shoe 15, the eyelets 34 constituting an anchoring point of the strap 14 on the shoe 15. The opposite end of the anchoring strap 14 is provided with a pad 36 of hook type fastening material for engagement with the pad 32 of loop type material on the inner face of the ankle band 16. The relative size of the fastening pads 36 and 32, as well as their specific location is selected so as to provide adjustability for fitting to legs of various sizes and furthermore, to ensure a contact area between the pads sufficient to provide the required degree of retaining force. Such construction details may vary according to the application, however they are well within the reach of a man skilled in the art and a more detailed description is not necessary here.

The ankle support system 10 is installed in the following manner. Firstly, the anchoring strap 14 is attached to the shoe 15 by removing the lace from the shoe 15 and placing the anchoring strap 14 inside the shoe, over the tongue thereof so that a number of eyelets 34 will be aligned with a number of eyelets on the shoe 15. Then, the lace is put back in place. To ensure a firm attachment of the anchoring strap 14 to the shoe 15, the lacing thereof should engage at least several of the eyelets 34, and preferably the first three eyelets should be double laced as shown at 38 in FIG. 2 (only one double laced eyelet being shown for simplicity) to ensure that the anchoring strap 14 is firmly secured to the shoe 15. The number of eyelets 34, as well as their spacing, is such that they extend over a substantial portion of the anchoring strap 14. The total number of eyelets 34 exceeds the minimum number of eyelets to receive the shoe lace in order to provide the required degree of retaining force, for adjustability purposes, so that the strap 14 may be installed on various types and sizes of lacing footwear.

When the anchoring strap 14 has been properly installed, it remains between the lacing and the tongue of the shoe 15, thus it is comfortable to wear and it will not create undue pressure or fatigue to the foot.

Figure 6:
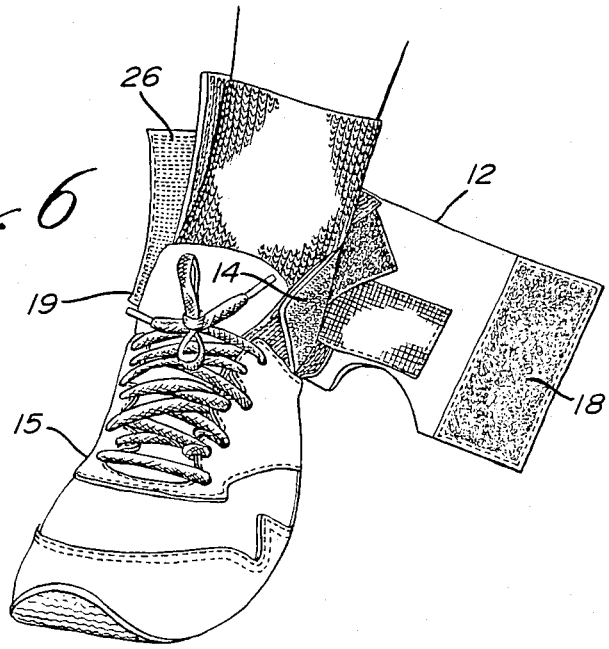
FIG. 6 illustrates a method of installing the leg brace on the leg.

The leg brace 12 is installed on the foot firstly by passing the retaining strap 28 under the arch of the foot or the inner sole of the shoe and pulling the extremity 29 until it reaches the position best shown in FIG. 6. At this point, the installation of the ankle support 10 is almost completed, requiring only to wrap the band 16 around the leg. The wrapping has the effect of, firstly, causing engagement between the pad 32 and the pad 36 on the anchoring strap 14, and secondly, to cause engagement between the pads 26 and 30 and finally, causing engagement between the pads 18 and 19 for fastening both ends of the band 16 together.

When the band 16 is wrapped on the foot, the stiffening strap 33 prevents the lower part of the band 16 to stretch and allows the upper part of the band 16 to do so. As a result, the band 16 assumes a somewhat frustroconical configuration preventing the band 16 to slide downwardly on the leg.

Locating the pad 36 between the leg of the user and the band 16 is an interesting feature which permits to use relatively small pads 36 and 32 and still obtain a high degree of retaining force due to the fact that the band 16, when wrapped on the leg, presses the two pads together.

In use, the anchoring strap 14, attached to the lacing and to the lower leg of the wearer, will prevent, or at least limit, movements of the type illustrated in FIG. 1 to protect against over-inversion of the ankle joint but, at the same time, the anchoring strap 14 will allow movements of the ankle within the normal range of motion of the ankle joint.

For optimum results, the wrapping of the band 16 over the leg to effect the connection between the band 16 and the anchoring strap 14, should be done while the foot is in extension, as shown in FIG. 6, so as to pretension and remove the slack from the anchoring strap 14.

Although the invention has been described above with reference to a specific embodiment, it will be plain to those skilled in the art that this embodiment may be refined and modified in various ways. Therefore, it is wished to have it understood that the above description should not be interpreted in any limiting sense since it is given only as an example. The scope of the invention is defined in the annexed claims.

The embodiments of the invention in which an exclusive property or privilege is claimed are define as follows:

1. An ankle support for use with athletic footwear of the type which includes laces for closing the footwear onto the wearer's foot, comprising:

a leg brace having means for removably fixing it to the leg of the wearer to directly encircle the leg above the footwear, and an anchoring strap for connecting the leg brace to the footwear, said anchoring strap being removably connectable to the leg brace and having a lace engaging means including a plurality of openings removably receiving the laces which close the athletic footwear, said leg brace and said anchoring strap together comprising a means for limiting over-inversion movement of the ankle joint of the wearer.

2. An ankle support system, as defined in claim 1, wherein said lace engaging means comprises a plurality of eyelets for receiving a lace.

3. An ankle support system, as defined in claim 2, whereas said eyelets are distributed over a substantial portion of said anchoring strap.

4. An ankle support system, as defined in claim 1, wherein said leg brace comprises:

an elongated flexible band to encircle the lower part of a leg of a user, said band having at the ends thereof, releasable fastening means; and a retaining strap having two ends mounted to said flexible band, said retaining strap passing under the planar surface of the arch of said foot.

5. An ankle support system, as defined in claim 4, wherein said retaining strap comprises one end permanently attached to said flexible band and an opposite end mounted to said flexible band by releasable fastening means.

6. An ankle system, as defined in claim 5, wherein said flexible band comprises two cut-out portions for accommodating the arch portion and the heel portion of said foot, respectively.

7. An ankle support system, as defined in claim 4, wherein said opposite end of said anchoring strap is removably attached to the inner face of said flexible band facing said leg.

8. An ankle support system, as defined in claim 4, wherein said elongated flexible band comprises a stiffening strap to prevent elongation of the lower portion of said band.

9. In combination:

an athletic footwear including a lace for closing said footwear on a foot and an ankle support system:

said ankle support system comprising:

a leg brace including means to directly encircle and be removably fixed to a leg of a wearer of the athletic footwear above the footwear, and an anchoring strap comprising means for connecting said leg brace to said athletic footwear, said anchoring strap being removably connectable to said leg brace and including a plurality of lace engaging openings for removably connecting said anchoring strap to said lace, said ankle support system constituting means for limiting an over-inversion movement of the ankle joint of the foot of the wearer.

* * * * *